US006003181A

United States Patent [19]

Wenk

[11] Patent Number: 6,003,181

[45] Date of Patent: Dec. 21, 1999

[54] COMBINED LETTER OPENER AND SHEET-LIKE MATERIAL CUTTER TOOL

[75] Inventor: Robert B. Wenk, San Clemente, Calif.

[73] Assignee: Pacific Handy Cutter, Inc., Costa Mesa, Calif.

[21] Appl. No.: 09/121,762

[22] Filed: Jul. 23, 1998

[51] Int. Cl.[6] ..... B26B 11/00

[52] U.S. Cl. ..... 7/160; 30/123; 30/294; 30/DIG. 3; D8/102

[58] Field of Search ..... 30/294, 289, 123, 30/DIG. 3; 7/160; D8/102, 103, 104

[56] References Cited

U.S. PATENT DOCUMENTS

| | | | |
|---|---|---|---|
| 221,163 | 11/1879 | England | 30/294 |
| D. 256,883 | 9/1980 | Wharmby | D8/102 |
| D. 306,394 | 3/1990 | Koenig | D8/102 |
| D. 329,584 | 9/1992 | Shevin | D8/102 |
| D. 334,702 | 4/1993 | Godsey | D8/102 |
| D. 342,008 | 12/1993 | Lage | D8/103 |
| D. 353,316 | 12/1994 | Schmidt | D8/104 |
| D. 355,347 | 2/1995 | Wenk | D8/103 |
| 419,271 | 1/1890 | Low | 30/289 |
| 3,009,248 | 11/1961 | Tilly | 30/294 |
| 4,530,154 | 7/1985 | DiCarlo | 30/294 |
| 5,285,577 | 2/1994 | Carney et al. | 30/294 |
| 5,720,062 | 2/1998 | Vaught | 30/294 |
| 5,724,738 | 3/1998 | Ballarini | 30/294 |
| 5,819,419 | 10/1998 | Schmidt | 30/294 |

FOREIGN PATENT DOCUMENTS

| | | | |
|---|---|---|---|
| 2720852 | 8/1978 | Germany | 30/294 |

*Primary Examiner*—Hwei-Siu Payer
*Attorney, Agent, or Firm*—Oppenheimer Wolff & Donnelly LLP

[57] ABSTRACT

A letter opening device is provided. The letter opening device includes a generally rectangular body having a letter opening blade for opening envelopes. The body is formed from a molded plastic material and is suitable for being hand held, and the letter opening blade is molded partially within the plastic molded body. The device further includes a sheet-like material cutter having a coupon cutting blade. A portion of the coupon cutting blade is exposed exteriorly of the body whereby the exposed portion can be manipulated to selectively separate sections of sheet-like materials such as paper and plastic sheets.

19 Claims, 2 Drawing Sheets

COMBINED LETTER OPENER AND SHEET-LIKE MATERIAL CUTTER TOOL

BACKGROUND OF THE INVENTION

1. Field of the Invention

This invention relates generally to letter opener devices for opening envelopes and to devices for cutting sheet-like materials such as paper sheets.

2. Background of the Invention

Documents and other sheet-like elements are often received in an envelope. Letter openers, generally in the form of a knife having a handle and blade, are used to open the envelope. Documents or other sheet-like elements such as letters, bills, flyers, and coupons are usually enclosed in such envelopes. Occasionally, a section or sections of a sheet need to be separated from the rest of the sheet. In these circumstances, scissors are usually used to cut out the desired section or sections. At the office or home, it is sometimes inconvenient to open the envelope with a letter opener, and then cut portions of the enclosed material with scissors. Fewer operating steps may be required to open an envelope and cut the enclosed sheet or sheets if a single device is capable of performing both these functions. Also, the inconvenience of locating both devices is somewhat reduced by having a single device which can open envelopes and separate sections of the sheet.

A problem often arises when using scissors to remove an interior section of a paper sheet without cutting the exterior portion. For example, binders for sales presentations and reports may include a front cover display sheet. The display sheet is generally presented in a pleasing manner by including a presentation frame, and the frame can be formed by removing the mid-portion of a paper sheet. If scissors are used to remove the mid-portion, at least a single cut through the frame has to be made in order to remove the mid-portion of the sheet. Other devices such as a knife-like cutter can be used, but they present other problems.

In addition to convenience, a safety issue arises when using knife-like letter openers, and when using scissors or knife-like cutters to cut sheet-like materials. At home, class rooms, and other places where children are present, these devices can present a dangerous situation due to the relatively long and pointed blade of knife-like letter openers, the relative long cutting edges and pointed tips of the two opposing scissors blades, and the relatively long, sharp, and pointed blade of a knife-like cutter.

Another problem which has not been resolved is the ability to conveniently and safely carry both a letter opener and a sheet-like material cutter. Often times, a need arises to open an envelope or cut portions of a paper sheet when away from the home or office. For example, coupons may be provided at the grocery market which need to be cut and separated prior to use. The shopper usually does not have scissors available to separate the printed coupon portion from the paper sheet and tries to improvise by folding the paper sheet along the dotted lines to form a crease, and tears along the crease. If the coupon is torn improperly, the shopper may discard the coupon rather than redeeming it at the cashier. Another situation where a carry-type sheet-like material cutter would be desirable is cutting newspaper articles when away from the home or office.

Carrying a separate letter opener and scissors in the front shirt pockets, coat pockets, or pant pockets can be uncomfortable and dangerous. The convenience and safety requirements are somewhat reduced when these devices can be carried in a briefcase, day-planner, purse, handbag, backpack, or the like. However, it is still preferable to carry as few items as possible, and also to carry items which are relatively small and lightweight. Reducing the number of items can be partially resolved by carrying multi-purpose devices. There is also the possibility of being pricked by the knife-like letter opener or scissors when searching for an item carried in the above mentioned bags.

The problem of conveniently and safely carrying a letter opener is resolved to a limited extent in U.S. Pat. No. 5,819,419. This application describes a letter opener having a flat and rectangularly shaped body with a utility type razor blade mounted between the body and an envelope flap insertion point. This letter opener can be easily carried in the pocket or bag without the possibility of being injured because the blade is relatively inaccessible to the operator. The body is formed from a molded plastic material and is suitable for being hand held by virtue of its size and light weight. However, the device described in the application is not designed to separate sections of sheet-like materials such as paper sheets.

Thus, there remains a need to provide a device which can open letters and cut sheet-like materials in a quick, easy, and safe manner. A need also exists for providing such a device which can be conveniently and safely carried in a pocket or bag.

BRIEF SUMMARY OF THE INVENTION

In accordance with the present invention, a device which can open envelopes and cut sheet-like materials is provided. The present invention achieves these objectives in a safe, convenient, and portable manner. In particular, the combination letter opener and sheet-like material cutter device is light weight, easily manipulated when used, easily stored because of its small size, and yet effective in opening envelopes and cutting sheet-like materials.

Generally, in accordance with a preferred illustrative embodiment of the present invention, the device includes a body suitable for being hand held. Preferably, the body is formed from a molded plastic and has a generally flat and rectangular shape so that it can be easily carried in a pocket or placed on a flat surface such as a desktop.

The letter opener is suited to open any type of envelope having a flap. The letter opener can open envelopes ranging in size from small personal envelopes to large 8½ inches by 11 inches or larger envelopes. In order to facilitate opening of envelopes, an envelope opening cutting blade is mounted to the body. The envelope blade may be a utility type razor blade having a cutting edge adjacent to an envelope flap insertion point. The envelope flap insertion point is preferably molded integrally with the body as a single unit. The portion of the insertion point extending beyond the envelope blade is spaced from the main portion of the body to allow the insertion point to be inserted and guide the envelope blade along the area where the flap joins the back side wall of the envelope.

In accordance with the preferred illustrative embodiment of the present invention, the device also includes a sheet-like material cutter which can be used to cut paper or plastic sheets. The cutter includes a coupon cutting blade having a cutting edge. The cutting edge is angled from the side edge of the body such that a cutting tip is exteriorly exposed, and the plane of the coupon blade is positioned parallel to the plane of the body such that the cutting tip protrudes at a 90° angle from the side edge surface of the body. Preferably, the cutting tip protrudes from the side edge of the body a distance approximately equivalent to the thickness of the sheet-like material. Thus, the cutting tip penetrates only the sheet to be cut, and the underlying surface is not cut by the cutting tip.

Other objects, features, and advantages of the present invention will become apparent from a consideration of the following detailed description.

DETAILED DESCRIPTION OF THE PREFERRED EMBODIMENTS

Figure 1:
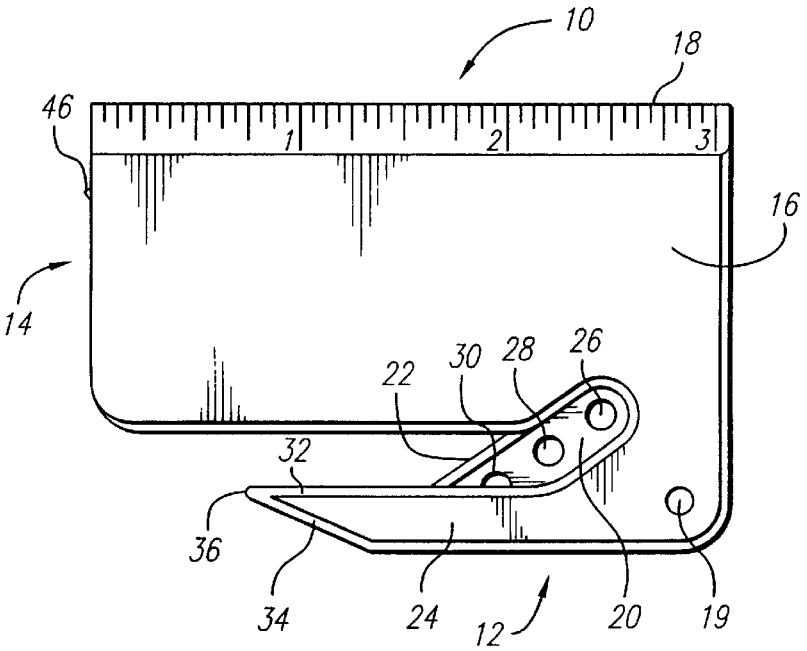
FIG. 1 is a top view of a preferred exemplary embodiment of a combined letter opener and sheet-like material cutter in accordance with the present invention.
Figure 2:
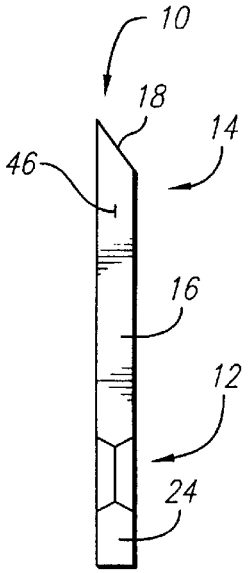
FIG. 2 is a side view of the device of FIG. 1.

The present invention relates to a combination letter opener and sheet-like material cutter device 10. The letter opener 12 of the combination device 10 is suited to open any type of envelope, while the sheet-like material cutter 14 is suited to cut any sheet-like material such as paper and plastic sheets. In the particular embodiment shown in the drawings and herein described, the combination device 10 is designed to be hand held. However, it should be understood that the principles of the present invention are equally applicable to virtually any form of letter opener and sheet-like material cutter. Therefore, it is not intended to limit the principles of the present invention to the specific embodiments shown and such principles should be broadly construed.

Referring to FIG. 1–4, the combination device 10 is preferably provided with a plastic molded body 16 suitable for being hand held by virtue of its size and light weight for use in opening envelopes and cutting sheet-like materials. The hand held plastic body 16 has a generally rectangular shape with a length of about 3.0 inches, a width of about 2.1 inches, and a thickness of about 0.1 inch. The plastic body 16 may be sized and shaped in other forms to accommodate different purposes. For typical carry-type usage, a relatively small and thin plastic body would be preferable such as the embodiment shown in FIGS. 1–5. Larger and thicker plastic bodies would be more appropriate for desktop usage, or for opening envelopes or cutting sheet-like materials which are relatively thick or large. The body 16 may also be configured in non-rectangular shapes such as a square, triangular, circular, oval, or any other shapes.

In the particular embodiment shown in the drawings and herein described, the body 16 is formed of a substantially solid and continuous construction. Preferably, the body 16 is molded from a high impact and inexpensive plastic material such as polyethylene. A ruler 18 can be integrally molded along the side of the body 16 as illustrated in FIG. 1. A hole 19 may also be integrally molded on the corner of the body 16 such that the combination device 10 can be hung on a nail or hook, or such that the combination device can be attached to a key chain or ring. It should be noted that other materials exhibiting similar qualities may also be used to form the body 16 such as polypropylene, polystyrene, polyvinyl chloride, acetyl and the like. The body 16 may also be formed from non-plastic materials such as aluminum, steel, magnesium, or other metals.

Figure 3:
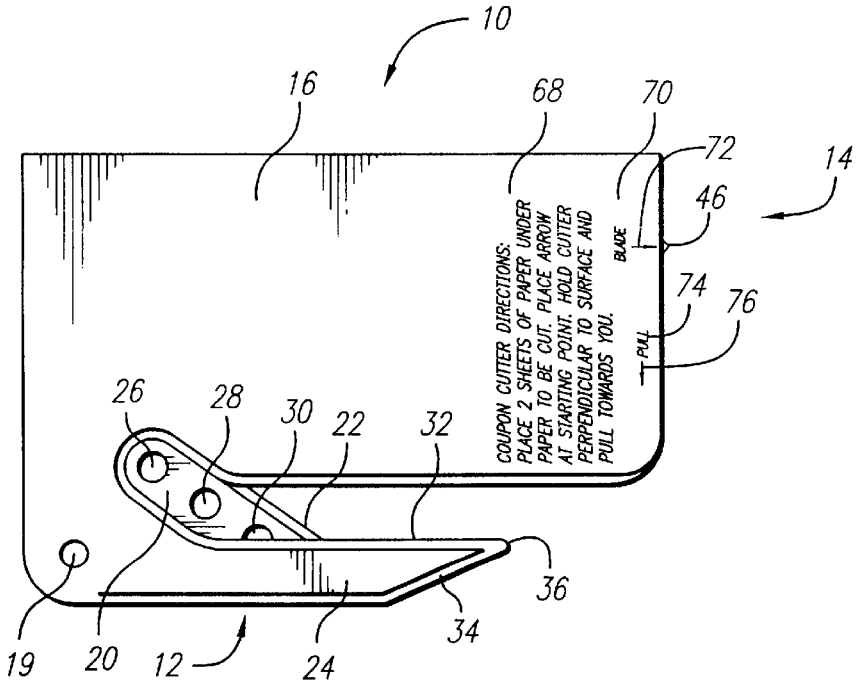
FIG. 3 is a bottom view of the device of FIGS. 1 and 2.
Figure 4:
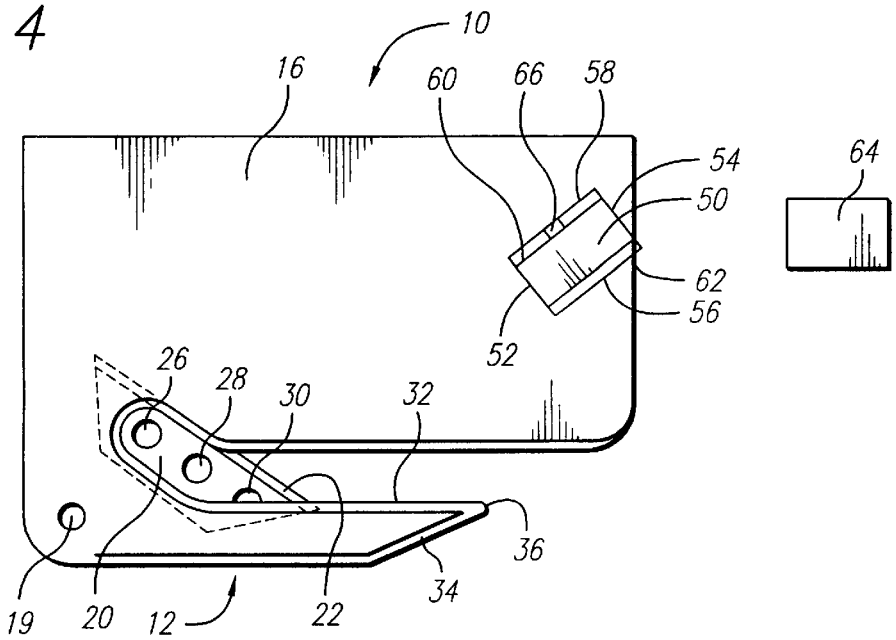
FIG. 4 is a top view of the device illustrating an envelope opening cutting blade and a recess for a coupon cutting blade.

In order to facilitate opening of envelopes, an envelope opening cutting blade 20 is mounted to the body 16 as seen in FIGS. 1–4. The envelope blade 20 may be a utility type razor blade having a cutting edge 22 adjacent to an envelope flap insertion point 24. The envelope blade 20 can have a trapezoidal configuration. As best seen in FIG. 4, the envelope blade 20 may be molded integrally with the body 16 in a known manner and thus positioned in the combination device 10 such that when the insertion point 24 is slid under the flap of an envelope and the combination device 10 is moved along the area where the flap joins the back side wall of the envelope, the envelope blade 20 cuts the envelope edge at such edge. The envelope blade 20 includes three holes 26, 28, 30. During the molding process, the envelope blade 20 can be positioned in the mold at the desired location by fitting the holes 26, 28, 30 onto three corresponding pins which extend from the inner surface of the mold. The envelope blade 20 can include fewer or more than three holes for positioning the envelope blade 20 at the desired location. Of course, the envelope blade 20 may or may not actually require holes for correctly positioning the envelope blade 20 in the mold.

The envelope blade 20 does not have to be integrally molded with the body 16. For example, the envelope blade 20 can be attached to the body 16 by other methods such as by forming a threaded hole (not shown) in the body 16, aligning the holes 26, 28, 30 of the envelope blade 20 with the threaded holes of the body 16, and inserting screws into the threaded holes of the body 16 and the holes of the envelope blade 20. In order to reduce the manufacturing costs, the screws can be replaced with pins, or the envelope blade 20 can be adhesively attached to the body 16. Preferably, the envelope blade 20 is formed from a high strength steel. If corrosion resistance is desirable, the envelope blade 20 may be formed from stainless steel.

The envelope flap insertion point 24 is preferably molded integrally with the body 16 as a single unit. As illustrated in FIGS. 1, 3 and 4, the side edges 32, 34 of the insertion point 24 are tapered to allow the insertion point to readily slide under the flap of an envelope, and the tip 36 of the insertion point 24 has a radius of about 0.02 inch. The portion of the insertion point 24 extending beyond the envelope blade 20 is spaced from the main portion of the body 16 to allow the insertion point 24 to be inserted and guide the envelope blade 20 along the area where the flap joins the back side wall of the envelope.

Figure 5:
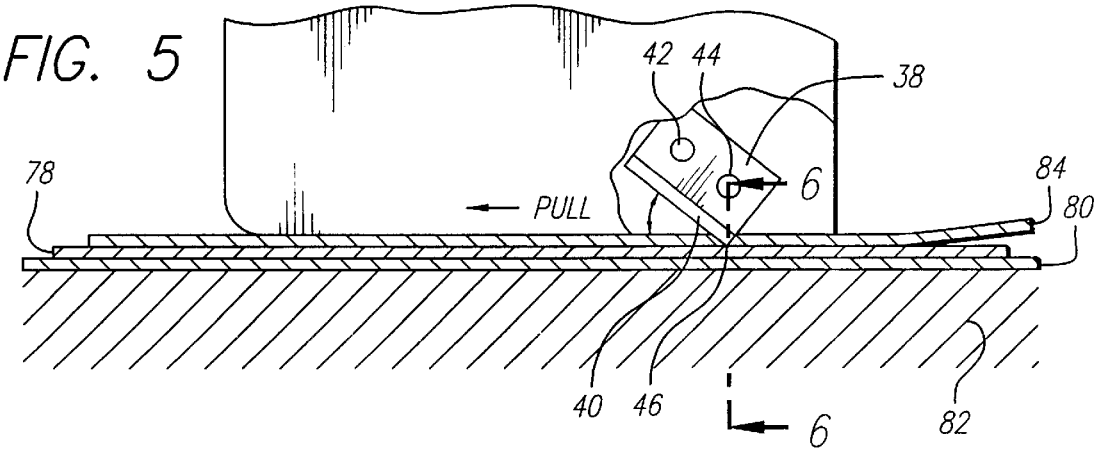
FIG. 5 is a plan view of the sheet-like material cutter with a layer of the body removed to illustrate the coupon cutting blade cutting the top sheet of paper.
Figure 7:
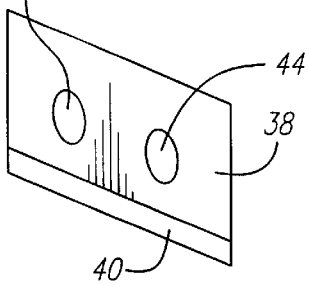
FIG. 7 is a plan view of the coupon cutting blade.

In accordance with the teaching of the present invention, the illustrated embodiment includes a sheet-like material cutter 14. The sheet-like material cutter 14 includes a coupon cutting blade 38 which may be a utility type razor blade having a cutting edge 40. As best seen in FIGS. 5 and 7, the coupon blade 38 is rectangularly shaped and has a height of about 0.4 inch, a width of about 0.5 inch, and a thickness of about 0.024 inch. It should be noted that the coupon blade 38 can also have a trapezoidal, circular, semi-circular, or any other appropriate configuration.

As illustrated in FIG. 5, the coupon blade 38 may be molded integrally with the body 16 in a manner similar to the envelope blade 20, and positioned in the body 16 such that the cutting edge 40 of the coupon blade 38 extends beyond the edge of the body 16. The coupon blade 38 includes two holes 42, 44 which can be used for alignment purposes during the molding process. The first hole 42 is located about 0.12 inch from the left side edge of the coupon blade 38 and about 0.15 inch from the top side edge of the coupon blade 38. The second hole 44 is located about 0.12 inch from the right side edge of the coupon blade 38 and 0.15 inch from the top side edge of the coupon blade 38.

As described above in respect to the envelope blade 20, the coupon blade 38 can include fewer or more than two holes, or the coupon blade have no holes. Also, the coupon blade 38 can be non-integrally molded to the body 16 and secured by other means such as by screws, pins, adhesives, or the like. When an adhesive is used, the holes 42, 44 can improve the attachment of the coupon blade 38 to the body 16 by increasing the contact area between the adhesive and coupon blade 38.

Figure 6:
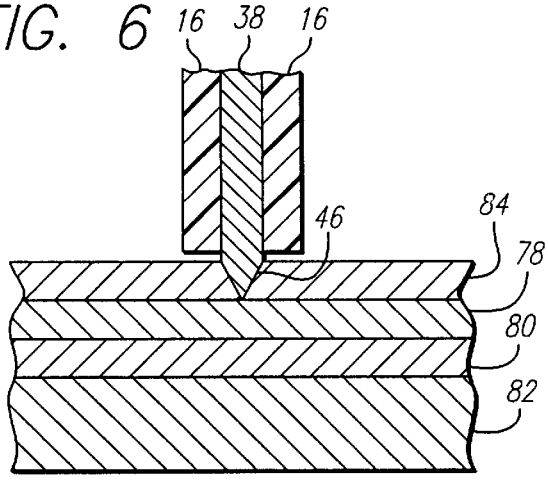
FIG. 6 is a detailed section view of the sheet-like material cutter taken along the plane 6—6 in FIG. 5 illustrating the coupon cutting blade penetrating only the top sheet.

The cutting edge 40 of the coupon blade 38, as shown in FIG. 5, is angled from the side edge of the body 16 such that a cutting tip 46 is exteriorly exposed. The preferred angle is approximately 45° but any acute angle can be used. If desired, the cutting edge 40 can also be positioned parallel to the edge of the body 16. The plane of the coupon blade 38 is positioned parallel to the plane of the body 16 such that the plane of the cutting tip 46 and coupon blade 38 are oriented at a 90° angle from the side edge surface of the body 16. Referring to FIGS. 5 and 6, the cutting tip 46 protrudes about 0.004 inch to about 0.014 inch beyond the side edge of the body 16, and can be triangularly shaped to allow the cutting edge 40 to easily slice through the sheet-like material. The amount of protrusion can be selected for the coupon blade 38 such that the cutting tip 46 is unable to perforate or cut the skin of a person.

The sheet-like material cutter 14 is primarily intended to cut single-sheets of paper from newspapers, magazines, books, letters, posters, and the like. In particular, the sheet-like material cutter 14 can be used to cut coupons printed on these paper sheets. However, the sheet-like material cutter 14 can be used to cut plastic and metallic sheet-like materials such as mylar films, shrink-wraps, and the like.

In an alternative embodiment, a generally rectangular recess, indicated generally at 48 in FIG. 4, is provided of a selectable size and configuration to receive the coupon blade 38. The recess, indicated generally at 48, is formed integrally of body 16 in the molding process in that the body 16 is provided with a relatively thin rear wall 50 and surrounding side walls including left wall 52, right wall 54, bottom wall 56, and top wall 58. The recess, indicated generally at 48, presents a generally rectangular opening in the exemplary embodiment facing laterally outwardly of body 16 to receive the coupon blade 38.

As illustrated in FIG. 4, shoulders 60, 62 are molded integrally of body 16 in the recess 48 and adjacent to the bottom wall 56 and top wall 58. The coupon blade 38 is attached to the recess 48 by an adhesive. A cover plate 64 is positioned over the recess, generally indicated at 48, and is attached to the shoulders 60, 62 with an adhesive. The top shoulder includes a slot 66. The slot 66 can be used to remove the coupon blade 38 by inserting a pointed object into the slot 66 and lifting out the coupon blade 38. The slot 66 can also act as a reservoir for the excess adhesive.

Referring to FIG. 3, instructions directed to operating the sheet-like material cutter 14 are molded integrally with the body 16. The instructions state "COUPON CUTTER DIRECTIONS: PLACE 2 SHEETS OF PAPER UNDER PAPER TO BE CUT. PLACE ARROW AT STARTING POINT. HOLD CUTTER PERPENDICULAR TO SURFACE AND PULL TOWARDS YOU." 68. Also molded into the body 16 is the indicia "BLADE" 70 and corresponding "↓" 72 pointing towards the cutting tip 46, and the indicia "PULL" 74 and corresponding "←" 76 pointing the direction in which the combination device 10 should be pulled. The instructions and indicia do not have to be molded integrally with the body 16. For example, they can be inscribed or painted on the body 16, or labels containing the instructions and indicia can be attached to the body 16.

Operation of the sheet-like material cutter 14 is as follows. As shown in FIGS. 5 and 6, typically the operator places two sheets of paper 78, 80 on a relatively flat working surface 82 such as a table. The sheet 84 to be separated into sections, such as a page from a newspaper upon which a coupon is printed, is placed over the two sheets of paper 78, 80. Next, the operator positions the combination device 10 such that the indicium "↓" 72 is placed at the starting point of the cut, and holds the combination device 10 such that the cutting tip 46 is perpendicular to the surface of the sheet 84. With the cutting tip 46 perpendicular to the surface of the sheet 84, the operator pulls the combination device 10 along the desired cutting path. Under most circumstances, the cutting tip 46 should only penetrate and cut the sheet 84 because the cutting tip 46 protrudes at a 90° angle from the side edge of the body 16 a distance approximately equivalent to the thickness of a standard sheet of letter writing paper as illustrated in FIG. 6. However, if the sheet 84 is thinner than a standard sheet of paper, the two sheets 78, 80 placed underneath the sheet 84 should protect the working surface 82. If the sheet 84 is unusually thin or a greater than normal downward force is required to cut the sheet 84, additional sheets can be placed underneath the sheet 84 for additional protection.

When the sheet-like material cutter 14 is used to cut shrink-wraps for packaging products such as music compact disks, toys, and the like, paper sheets generally cannot be placed underneath the shrink-wrapper to protect the surface underneath the shrink-wrap. Under these circumstances, the operator can avoid damaging the surface underneath the shrink-wrap by applying the appropriate downward force to cut only the shrink-wrap.

The foregoing detailed description and the accompanying drawings describe illustrative preferred embodiments of the invention. Other arrangements may be provided along the same likes. Thus, by way of example and not of limitation, the sheet-like material cutter can include a retractable coupon blade such that the penetration depth can be adjusted to the thickness of the sheet-like material, and the coupon blade can be fully retracted when not in use. Accordingly, the invention is not limited to the precise embodiment shown in the drawing and described in detail hereinabove.

What is claimed is:

1. A paper cutting tool comprising in combination:

a molded plastic body suitable for being hand held, said body being about the size of a card such that said paper cutting tool may be carried in a pocket;

an envelope opening cutting blade having a first cutting edge exposed in a recess opening molded into said body, said envelope opening cutting blade embedded in said body;

an envelope flap insertion point provided on said body and adjacent to said envelope cutting blade;

a coupon cutting blade embedded in said body with only a cutting tip of said coupon cutting blade exposed exteriorly of said body, said coupon cutting blade being rectangularly-shaped and having four sides, one of said sides having a second cutting edge parallel to a longitudinal axis of said coupon cutting blade, said second cutting edge inclined at an acute angle to a side edge of said body; and a recess within said body to receive said coupon cutting blade, said recess being rectangularly-shaped and having a left wall, a right wall, a bottom wall and a top wall, said coupon cutting blade secured to said body by having said four sides of said coupon cutting blade directly abutting said four walls of said recess;

whereby said tool can be manipulated to selectively open a sealed envelope and separate sections of a sheet as in separating a coupon portion of a product advertisement on a sheet of paper;

whereby the sealed envelope is opened by manually inserting said envelope flap insertion point beneath an envelope flap and used to cut the envelope edge where the flap joins a side wall of the envelope; and whereby said cutting tip is equilaterally-shaped with a vertex extending outwardly and perpendicularly to said side edge of said body to perforate the sheet to be separated, said cutting tip disposed near a mid-section of said side edge of said body such that all four sides of said coupon cutting blade are supported by said four walls of said recess.

2. The paper cutting tool of claim 1 wherein said coupon cutting blade further includes at least one hole, said at least one hole being filled with adhesive to improve the attachment of said coupon cutting blade to said body.

3. The paper cutting tool of claim 1 further comprising a cover plate covering said recess, wherein said recess further includes a first shoulder adjacent to said bottom wall and a second shoulder adjacent to said top wall, said cover plate attached to said first and second shoulders with an adhesive.

4. The paper cutting tool of claim 1 wherein said coupon cutting blade has length about twice its width to provide adequate contact area between side surfaces of said coupon cutting blade and said molded plastic body.

5. The paper cutting tool of claim 1 wherein said cutting tip protrudes from said body a distance approximating the thickness of one sheet of letter grade paper.

6. The paper cutting tool of claim 1 wherein said molded plastic body is integrally formed from a single piece of plastic material.

7. The paper cutting tool of claim 1 wherein said acute angle is approximately 45°.

8. The paper cutting tool of claim 1 wherein said cutting tip protrudes about 0.004 inch to about 0.014 inch.

9. The paper cutting tool of claim 1 further including a ruler integrally formed in said body, and wherein said envelope opening cutting blade and said coupon cutting blade are integral with said body.

10. The paper cutting tool of claim 1 further including a first indicia on said body indicating the location of said coupon cutting blade.

11. The paper cutting tool of claim 10 wherein said first indicia comprises an arrow pointing to the location on said body where said coupon cutting blade is exposed.

12. The paper cutting tool of claim 11 further including a second indicia on said body adjacent said side edge where said coupon cutting blade is exposed exteriorly of said body giving operating instruction to facilitate use of said coupon cutting blade, wherein said second indicia comprises an arrow and letters giving said operating instruction including its manner of manipulating said coupon cutting blade for separating said coupon portion of the product advertisement.

13. In an envelope opening tool having a first blade embedded in a molded plastic material body with a first cutting edge exposed by a recessed opening in said body to facilitate the opening of an envelope by sliding a portion of an envelope flap insertion point under an envelope flap to bring said first cutting edge into contact with and cut open a lateral edge of a sealed envelope, the improvement comprising the provision of:

a second blade rectangularly-shaped with four sides, said second blade embedded in said molded plastic material body with a cutting tip of said second blade extending outwardly of a side edge of said body, one of said four sides of said second blade having a second cutting edge parallel to a longitudinal axis of said second blade, said second cutting edge inclined at an acute angle to said side edge of said body; and a recess within said body to receive said second blade, said recess being rectangularly-shaped and having a left wall, a right wall, a bottom wall and a top wall, said second blade secured to said body by having said four sides of said second blade directly abutting said four walls of said recess;

whereby said second blade can be manipulated to selectively separate sections of sheet material, said cutting tip being equilaterally-shaped with a vertex extending outwardly and perpendicularly to said side edge of said body to perforate the sheet material to be separated, said cutting tip disposed near a mid-section of said side edge of said body;

said body being about the size of a typical business card such that said body can be carried in a pocket.

14. The improvement of claim 13 further comprising a cover plate covering said recess, wherein said recess includes a first shoulder adjacent to said bottom wall and a second shoulder adjacent to said top wall, said cover plate attached to said first and second shoulders with an adhesive.

15. The improvement of claim 13 wherein said second blade is a coupon cutting blade.

16. The improvement of claim 13 wherein said cutting tip extends outwardly of said side edge of said body a distance of approximately the thickness of a standard sheet of letter writing paper.

17. The improvement of claim 13 wherein said acute angle is approximately 45°.

18. The improvement of claim 13 further including a first indicia on said body, said first indicia comprising an arrow pointing to the location on said body where said second blade is exposed.

19. The improvement of claim 18 further including a second indicia on said body adjacent said side edge where said second blade is exposed exteriorly of said body giving operating instruction to facilitate use of said second blade, said second indicia comprising another arrow and letters giving said operating instructions including the manner of manipulating said second blade for separating the sections of sheet material.

* * * * *